US009205300B2

(12) United States Patent
Ishii et al.

(10) Patent No.: US 9,205,300 B2
(45) **Date of Patent: *Dec. 8, 2015**

(54) TRAINING SYSTEM

(71) Applicants: Hitachi, Ltd, Tokyo (JP); Takei Scientific Instruments Co., Ltd., Niigata (JP); Yokohama National University, Yokohama (JP)

(72) Inventors: Hiroshi Ishii, Kashiwa (JP); Shizuo Takatou, Nagaoka (JP); Kenichi Honda, Niigata (JP); Hajime Watanabe, Gosen (JP); Kouichi Yamada, Niigata (JP); Yasuyuki Murayama, Niigata (JP); Toshihiko Shiraishi, Yokohama (JP); Shin Morishita, Funabashi (JP)

(73) Assignees: HITACHI, LTD., Tokyo (JP); TAKEI SCIENTIFIC INSTRUMENTS CO., LTD., Niigata (JP); YOKOHAMA NATIONAL UNIVERSITY, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/572,910

(22) Filed: Dec. 17, 2014

(65) Prior Publication Data

US 2015/0099608 A1 Apr. 9, 2015

Related U.S. Application Data

(63) Continuation of application No. 13/311,768, filed on Dec. 6, 2011, now Pat. No. 8,932,183.

(30) Foreign Application Priority Data

Dec. 7, 2010 (JP) ..... 2010-272772

(51) Int. Cl.
*A63B 24/00* (2006.01)
*A63B 15/02* (2006.01)

(Continued)

(52) U.S. Cl.
CPC ..... *A63B 24/0075* (2013.01); *A63B 21/0056* (2013.01); *A63B 21/0085* (2013.01);
(Continued)

(58) Field of Classification Search
USPC ..... 482/1, 4
See application file for complete search history.

(56) References Cited

U.S. PATENT DOCUMENTS 2,681,650 A * 6/1954 Goss ..... 601/98
2,869,539 A * 1/1959 Mosse ..... 601/98

(Continued)

FOREIGN PATENT DOCUMENTS

JP S60-34859 3/1985
JP 03-202076 9/1991

(Continued)

OTHER PUBLICATIONS

JP Office Action for Japanese Application No. 2010-272772, issued on Dec. 3, 2013.

(Continued)

*Primary Examiner* — Loan H Thanh
*Assistant Examiner* — Shila Jalalzadeh Abyan
(74) *Attorney, Agent, or Firm* — Baker Botts L.L.P.

(57) ABSTRACT

Training system including: a training machine including: a Magnet Rheological fluid (MR-fluid) load generating unit generating a load to be exerted on the trainee, by using an MR-fluid having a variable viscosity depending on a magnetic field strength; mechanical arrangements; a displacement detection sensor; a power-assisting motor; a storage unit configure to store MR-fluid load characteristic information on a relationship between a current through the MR-fluid load generating unit and the load generated by the MR-fluid load generating unit; and chain and sprocket arrangements.

5 Claims, 8 Drawing Sheets

(51) Int. Cl.

| | |
|---|---|
| ***A63B 71/00*** | (2006.01) |
| ***A63B 21/005*** | (2006.01) |
| ***A63B 21/008*** | (2006.01) |

(52) U.S. Cl.

CPC ..... *A63B24/0087* (2013.01); *A63B 2024/0093* (2013.01); *A63B 2220/22* (2013.01); *A63B 2220/51* (2013.01)

(56) References Cited

U.S. PATENT DOCUMENTS

| | | | | |
|---|---|---|---|---|
| 4,900,013 | A * | 2/1990 | Rodgers, Jr. | 482/70 |
| 4,986,261 | A * | 1/1991 | Iams et al. | 601/35 |
| 5,098,088 | A * | 3/1992 | Cohen et al. | 482/5 |
| 5,569,120 | A | 10/1996 | Anjanappa et al. | |
| 5,741,922 | A | 4/1998 | Yoshino | |
| 6,050,920 | A * | 4/2000 | Ehrenfried | 482/6 |
| 2009/0098984 | A1* | 4/2009 | Smyrk et al. | 482/72 |
| 2011/0256983 | A1* | 10/2011 | Malack et al. | 482/4 |

FOREIGN PATENT DOCUMENTS

| | | | |
|---|---|---|---|
| JP | 05-137814 | | 6/1993 |
| JP | 06-263660 | | 9/1994 |
| JP | 2002-126122 | | 5/2002 |
| JP | 2006-247280 | | 9/2006 |
| JP | 2008-272361 | | 11/2008 |
| JP | 2008272361 | | 11/2008 |
| JP | 2008272361 | A * | 11/2008 |
| JP | 2009-050699 | | 3/2009 |
| JP | 2009-225869 | | 10/2009 |
| JP | 2009-225870 | | 10/2009 |
| WO | WO 2010/104266 | | 9/2010 |

OTHER PUBLICATIONS

JP Office Action for Japanese Application No. 2010-272772, issued on Apr. 8, 2014.

Notification of Reasons for Refusal from KIPO; JP Translation of Notification of Reasons for Refusal; English Translation of Notification of Reasons for Refusal for Application No. 10-2011-129615, issued on Mar. 6, 2013.

* cited by examiner

321 VELOCITY-LOAD RELEVANT INFORMATION

322 MR-FLUID LOAD CHARACTERISTIC INFORMATION

323 MOTOR-LOAD CHARACTERISTIC INFORMATION

FIG.5A NORMAL EXAMPLE

FIG.5B FAILURE EXAMPLE 1

FIG.5C FAILURE EXAMPLE 2

TRAINING SYSTEM

CROSS REFERENCE TO RELATED APPLICATION

This is a continuation of U.S. application Ser. No. 13/311,768, filed Dec. 6, 2011. This application relates to and claims priority from Japanese Patent Application No. 2010-272772, filed on Dec. 7, 2010. The entirety of the contents and subject matter of all of the above is incorporated herein by reference.

BACKGROUND OF THE INVENTION

1. Field of the Invention

The present invention relates to a training system for use by a trainee for training.

2. Description of the Related Art

Recently, health consciousness has been rising in the entire country, and various programs and plans for prevention of functional decline and the like are currently being implemented. In conjunction with the rising health consciousness and the implementation of the above programs and plans, an increasing number of aged people are doing exercise by using training machines. The training machines include, for example, leg press machines (for training leg muscles) and chest press machines (for training chest and arm muscles). The training machines impose loads on trainees by using a motor, weight plates (metal plates), hydraulic pressure, and the like.

In addition, for example, Japanese Patent Laid-Open No. 2002-126122 (hereinafter referred to as JP2002-126122A) discloses a technique in which an exercise load is imposed by using Magneto Rheological (MR) fluid. According to this technique, the characteristics of the MR fluid enable easy realization of high-speed response and high load.

However, the technique disclosed in JP2002-126122A cannot improve the neuromuscular coordination (i.e., the coordination between the nervous system and muscles) although the disclosed technique enables the training for improving the muscular strength and the muscular endurance. It is considered that improvement of the neuromuscular coordination, as well as the training for the muscular strength and the muscular endurance, is important for maintaining human health.

The present invention has been developed in view of the above circumstances. The object of the present invention is to provide a training system which enables improvement of the neuromuscular coordination as well as the training for the muscular strength and the muscular endurance.

SUMMARY OF THE INVENTION

In order to achieve the object, the present invention provides a training system for training of a predetermined part of a body of a trainee. The training system includes a training machine which generates a load using MR-fluid, a control device which controls the training machine, and a display unit which displays a game screen. The training machine includes: a MR-fluid load generating unit which generates a load to be imposed on the trainee, by using an MR (Magneto Rheological) fluid having viscosity varying with a magnetic field strength; a mechanical unit which transmits to the trainee the load generated by the MR-fluid load generating unit; and a displacement detection sensor which detects a training motion of the trainee. The control device includes: a storage unit which stores MR-fluid load characteristic information, a target load in training, and game information, where the MR-fluid load characteristic information indicates a relationship between current in the MR-fluid load generating unit and the load generated by the MR-fluid load generating unit, and the game information indicates details of a game related to the training; and a calculation unit which controls the MR-fluid load generating unit by using the MR-fluid load characteristic information and the target load, generates an image corresponding to the training motion on the basis of the game information and the training motion, and makes the display unit display the image.

DETAILED DESCRIPTION OF THE PREFERRED EMBODIMENT

Hereinbelow, an embodiment of the present invention is explained with reference to the accompanying drawings.

1. Construction of Training System

Figure 1:
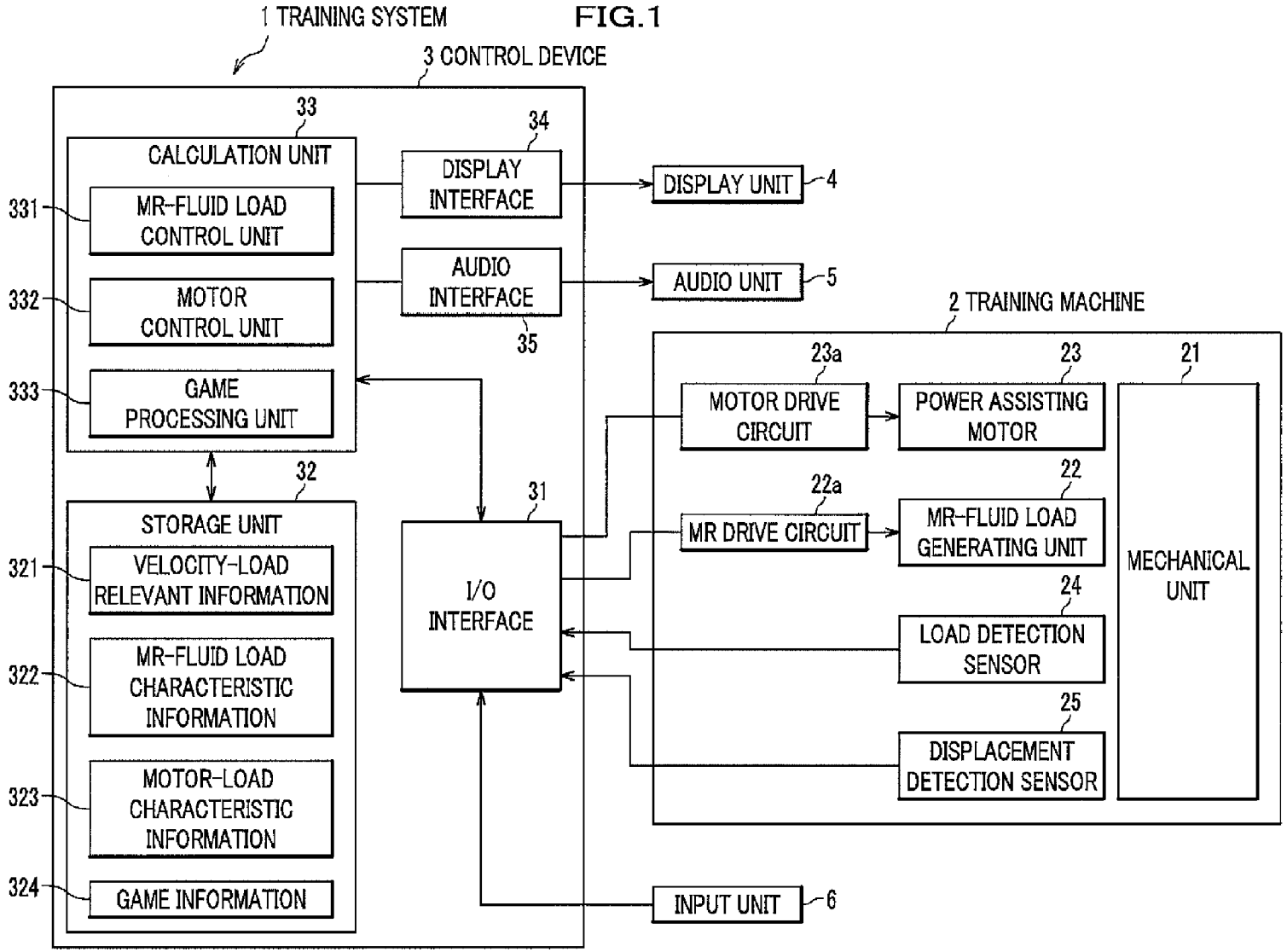
FIG. 1 is a diagram illustrating a construction of a training system according to an embodiment of the present invention.

The construction of the training system according to the present embodiment is explained below. As illustrated in FIG. 1, the training system includes a training machine 2, a control device 3, a display unit 4, an audio unit 5, and an input unit 6.

The training machine 2 is a device for use by a trainee to perform training. Generally, the training system 1 having the construction of FIG. 1 enables training of any parts of the body of the trainee. For example, the parts may be the arms, chest, abdomen, back, legs, and the like. The training machine 2 includes a mechanical unit 21, an MR-fluid load generating unit 22, an MR drive circuit 22*a*, a power-assisting motor 23, a motor drive circuit 23*a*, a load detection sensor 24, and a displacement detection sensor 25.

The mechanical unit 21 includes a mechanism or a structure for transmission of loads. Details of the mechanical unit 21 will be explained later with reference to FIG. 2.

The MR-fluid load generating unit 22 includes a device which generates a load by use of an MR fluid, and can be realized by, for example, a piston structure containing an MR fluid and an electromagnetic coil. When no magnetic field is applied to the MR fluid, the MR fluid has a liquid form as the conventional hydraulic oil, and behaves as a Newtonian liquid. On the other hand, when a magnetic field is externally applied to the MR fluid, the magnetic particles homogeneously dispersed in the MR fluid are concatenated along the direction of the magnetic field, and form chain-like clusters. Since the chain-like clusters resist against deformation (or flow) of the MR fluid, application of the magnetic field rapidly increases the apparent viscosity, so that the MR fluid behaves as a plastic fluid having yield stress during flow of the MR fluid.

The above change in the viscosity of the MR fluid caused by the magnetic field is reversible. Therefore, when the magnetic field is removed, the MR fluid quickly returns to the initial state. In addition, the degree of the viscosity change can be controlled by adjusting the strength of the magnetic field. The state of the MR fluid can vary extremely quickly, and the response time to change in the magnetic field is as small as several milliseconds. Therefore, the provision of the MR-fluid load generating unit 22 enables easy achievement of high-speed response and high load. The MR drive circuit 22*a* is a circuit for driving the MR-fluid load generating unit 22.

The power-assisting motor 23 is a means for canceling at least part of the load generated by the MR-fluid load generating unit 22 (especially, the initial resistance value, which is explained in detail later) and the mechanical friction force in the mechanical unit 21, and adjusting the load which is actually imposed on the trainee, to an appropriate level. The motor drive circuit 23*a* is a circuit for driving the power-assisting motor 23.

The load detection sensor 24 is a means for detecting the load generated by the trainee's training motion and can be realized by, for example, a load cell. The displacement detection sensor 25 is a means for detecting a displacement of a predetermined part (e.g., a hand of the trainee or a movable part of the training machine 2) during the trainee's training, and can be realized by, for example, a rotary encoder.

The control device 3 includes an I/O interface 31, a storage unit 32, a calculation unit 33, a display interface 34, and an audio interface 35, and can be realized by, for example, a PC (personal computer).

The I/O interface 31 is a means for receiving signals from the training machine 2 and the input unit 6, and outputting signals to the training machine 2. The I/O interface 31 can be realized by, for example, an electronic circuit.

The storage unit 32 is a means for storing various information including velocity-load relationship information 321, MR-fluid load characteristic information 322, motor-load characteristic information 323, and game information 324. The storage unit 32 can be realized by, for example, a ROM (read only memory), an HD (hard disk), and the like. In addition, the storage unit 32 also stores various operational programs (not shown) which realize the functions of the calculation unit 33.

The velocity-load relationship information 321 is information indicating a relationship between the trainee's training motion and the corresponding target load. Details of the velocity-load relationship information 321 will be explained later with reference to FIG. 3A.

The MR-fluid load characteristic information 322 is information indicating a relationship between the value of the current flowing through the MR-fluid load generating unit 22 and a value of the load generated in the MR-fluid load generating unit 22 by the flow of the current. Details of the MR-fluid load characteristic information 322 will be explained later with reference to FIG. 3B.

The motor-load characteristic information 323 is information indicating a relationship between the value of the voltage applied to the power-assisting motor 23 and the magnitude of the power-assisting force generated by the power-assisting motor 23 in response to application of the value of the voltage. Details of the motor-load characteristic information 323 will be explained later with reference to FIG. 3C.

The game information 324 is information on a game related to the training, and includes, for example, details of the game, information on the game screen, audio information, and the like. Details of the game information 324 will be explained later with reference to FIG. 4.

The calculation unit 33 includes an MR-fluid load control unit 331, a motor control unit 332, and a game processing unit 333, and can be constituted by, for example, a CPU (central processing unit) and a RAM (random access memory).

The MR-fluid load control unit 331 controls the load generated by the MR-fluid load generating unit 22, based on the velocity of the trainee's training motion and the velocity-load relationship information 321. Details of the operations of the MR-fluid load control unit 331 will be explained later with reference to FIG. 7.

The motor control unit 332 controls the power-assisting force generated by the power-assisting motor 23, based on the MR-fluid load characteristic information 322 and the motor-load characteristic information 323 Details of the operations of the motor control unit 332 will be explained later with reference to FIG. 7.

The game processing unit 333 performs processing for the game during the training based on the game information 324, makes the display unit 4 display the game screen, and makes the audio unit 5 output sound.

The display interface 34 instructs the display unit 4 for display in accordance with an instruction from the game processing unit 333.

The audio interface 35 instructs the audio unit 5 for audio output in accordance with an instruction from the game processing unit 333.

The display unit 4 displays the game screen according to the instruction from display interface 34, and can be realized by, for example, a liquid-crystal display device.

The audio unit 5 outputs sound according to the instruction from the audio interface 35, and can be realized by, for example, one of various speakers.

2. Example of Training Machine

Figure 2:
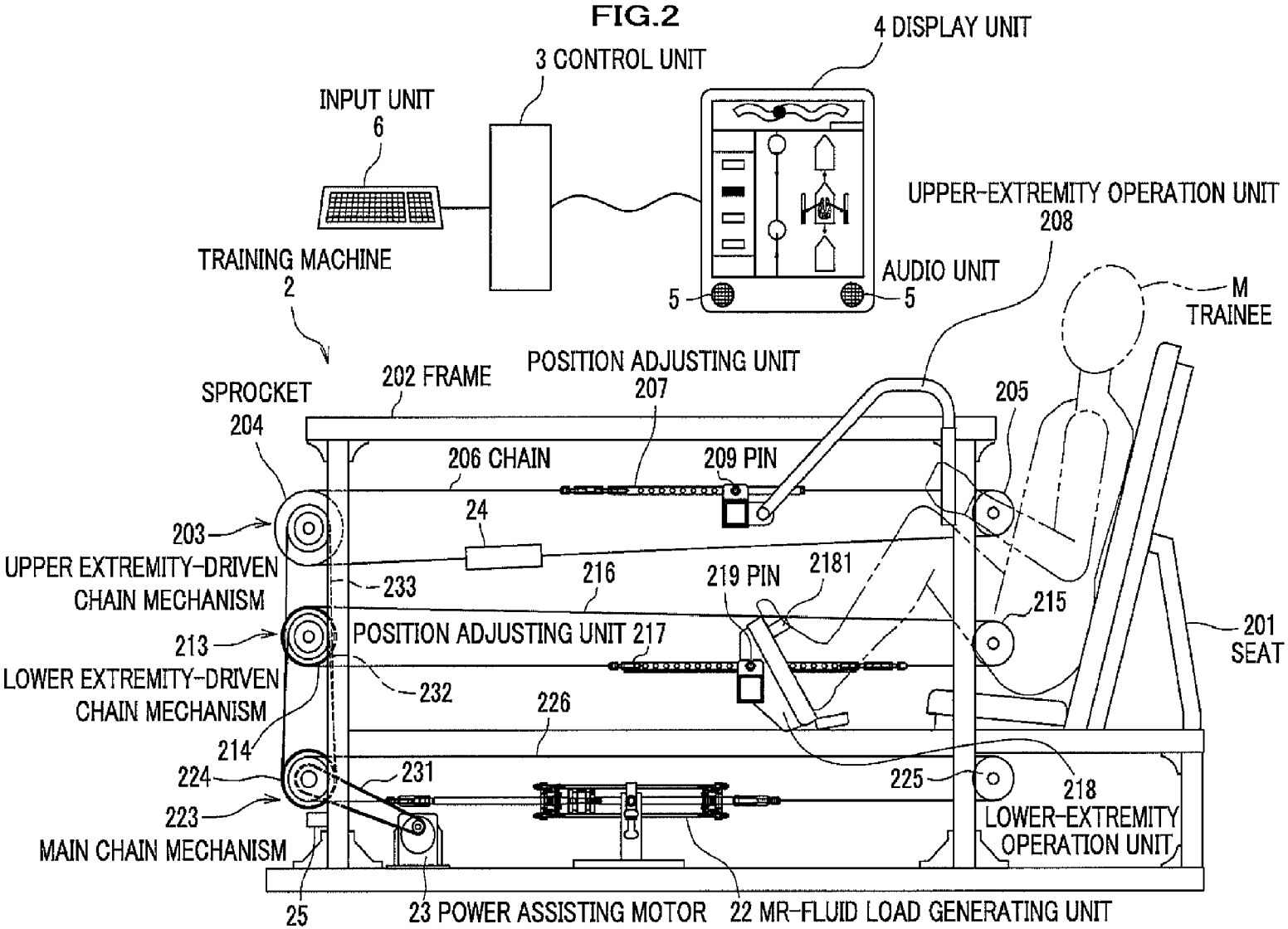
FIG. 2 is a diagram schematically illustrating an example of a configuration of a training machine.

Next, an example of the training machine 2 is explained below with reference to FIG. 2, where the training machine 2 is a composite machine of a leg press machine and a rowing machine. As illustrated in FIG. 2, the training machine 2 is constituted by a main chain mechanism 223, a lower-extremity chain mechanism 213, and an upper-extremity chain mechanism 203, which are arranged on a frame 202.

The main chain mechanism 223 is constituted by two sprockets 224 and 225 and a chain 226 engaged with the sprockets 224 and 225. The MR-fluid load generating unit 22 is arranged on the chain 226 at a position between the sprockets 224 and 225 in such a manner that the chain 226 moves against the load generated by the MR-fluid load generating unit 22. The sprocket 224 and the power-assisting motor 23 are linked through a chain 231. In addition, the displacement detection sensor 25 is arranged near the sprocket 224, and detects the movement of the sprocket 224 caused by the trainee's training motion, as the aforementioned displacement of the predetermined part during the trainee's training.

The lower-extremity chain mechanism 213 is constituted by two sprockets 214 and 215 and a chain 216 engaged with the sprockets 224 and 225. A position adjustment unit 217 having a plurality of holes (which corresponds to the second position adjustment unit) is attached to a portion of the chain 216, so that the chain 216 and the position adjustment unit 217 move together. A lower-extremity operation unit 218, to which the trainee M applies force with the legs and which has a hole, is fixed to the position adjustment unit 217 by inserting a pin 219 (which corresponds to the second pin) through the hole in the lower-extremity operation unit 218 and one of the plurality of holes in the position adjustment unit 217. In addition, a fastening means 2181 (e.g., fastening belts) for fastening the feet of the trainee is arranged on the lower-extremity operation unit 218 in order to enable the trainee to apply force in the pulling direction.

The upper-extremity chain mechanism 203 is constituted by two sprockets 204 and 205 and a chain 206 engaged with the sprockets 204 and 205. A position adjustment unit 207 having a plurality of holes (which corresponds to the first position adjustment unit in claims 13 and 14) is attached to a portion of the chain 206, so that the chain 206 and the position adjustment unit 207 move together. An upper-extremity operation unit 208, to which the trainee M applies force with the arms and which has a hole, is fixed to the position adjustment unit 207 by inserting a pin 209 (which corresponds to the first pin in claims 13 and 14) through the hole in the upper-extremity operation unit 208 and one of the plurality of holes in the position adjustment unit 207. In addition, the load detection sensor 24, for example, a tension load cell, is arranged on the chain 226 at a position between the sprockets 204 and 205. The load detection sensor 24 detects the magnitude of the load (force) caused by the trainee's training motion, by detecting the tensile force occurring in the chain 206.

A chain 232 is engaged with sprockets 224 and 214, and a chain 233 is engaged with sprockets 224 and 204. Thus, all the sprockets and chains are linked.

In addition, a seat 201 is arranged in the training machine 2. When the trainee M sits on the seat 201, the trainee M can pull the upper-extremity operation unit 208 with the arms while pushing the lower-extremity operation unit 218 (having the fixing means 2181) with the legs, and push the upper-extremity operation unit 208 with the arms while pulling the lower-extremity operation unit 218 with the legs. Thus, the trainee M can perform training by receiving loads generated by the MR-fluid load generating unit 22. In addition, the trainee M can watch the game screen on display unit 4 and listens to the sound outputted from the audio unit 5 during the training.

3. Velocity-Load Relationship

Figure 3A:
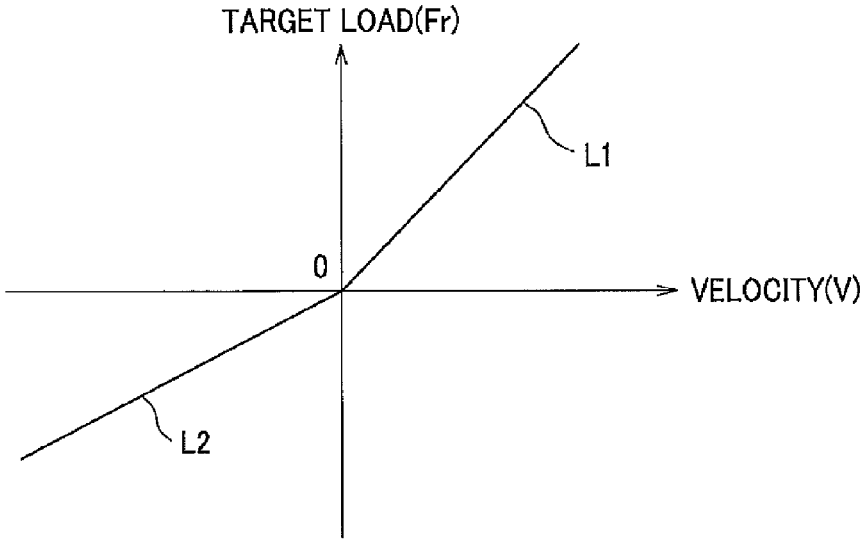
FIG. 3A is a graph indicating an example of velocity-load relationship information.

The velocity-load relationship information 321 is explained below with reference to FIG. 3A. As indicated in FIG. 3A, the velocity-load relationship information 321 can be represented by the lines L1 and L2 in the graph of the target load Fr versus the velocity V of the training motion. In the graph of FIG. 3A, the velocity in the direction of pushing the lower-extremity operation unit 218 with the legs is assumed to be positive, and the velocity in the opposite direction is assumed to be negative. In the case where the velocity-load relationship information 321 is set in such a manner that the lines L1 and L2 are connected in the vicinity of the origin and the direction of the load when the velocity is positive is opposite to the direction of the load when the velocity is negative, the trainee M does not suffer from a great shock when the direction of the motion is changed, so that the trainee M can smoothly perform full concentric exercise (i.e., bidirectional concentric exercise).

Although the muscles can generate force only in the directions in which the muscles contract, the muscle training includes concentric exercise and eccentric exercise. In the concentric exercise, the muscle generates force while the muscle contracts. An example of the concentric exercise is the training of straightening the knees while pushing the foot pedals (constituting the lower-extremity operation unit 218) in the leg press exercise. During the concentric exercise, the quadriceps femoris muscle (a muscle group on the front of a thigh) generates force in the direction of contraction of the quadriceps femoris muscle while the quadriceps femoris muscle contracts. On the other hand, in the eccentric exercise, the muscle generates force while the muscle extends. An example of the eccentric exercise is the training of bending the knees while pushing the foot pedals in the leg press exercise. During the eccentric exercise, the quadriceps femoris muscle generates force in the direction of contraction of the quadriceps femoris muscle while the quadriceps femoris muscle extends.

It is generally said that the eccentric exercise is more effective in strengthening muscles than the concentric exercise. This is because the eccentric exercise causes a greater degree of damage to muscular fibers than the concentric exercise, so that the eccentric exercise can more easily cause muscular hypertrophy by a damage recovery mechanism than the concentric exercise.

However, the eccentric exercise causes the (delayed) onset muscular soreness at relatively high frequency. Therefore, it is said that the concentric exercise is more suitable for senior people and sick or injured people performing rehabilitation, apart from professional athletes and the like. Thus, the concentric exercise is more suitable for the training for health maintenance and prevention of physical decline than the eccentric exercise. For example, it is preferable that the leg press exercise including pushing the foot pedals while straightening the knees further include pulling the foot pedals while bending the knees, because concentric exercise can be performed in both of the motions of pushing and pulling the foot pedals. In addition, in the training system 1 in the present embodiment, the relationship between the velocity and the target load can be freely set according to the purpose of the exercise, and either of concentric exercise and eccentric exercise can be realized by the setting of the relationship between the velocity and the target load.

4. MR-Fluid Load Characteristic Information

Figure 3B:
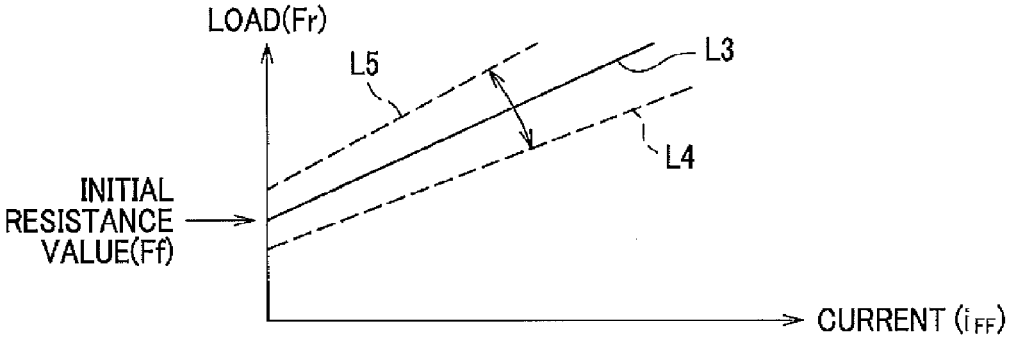
FIG. 3B is a graph indicating an example of MR-fluid load characteristic information.

The MR-fluid load characteristic information 322 is explained below with reference to FIG. 3B. As indicated in FIG. 3B, the MR-fluid load characteristic information 322 can be represented by the line L3 in the graph of the load Fr generated by the MR-fluid load generating unit 22 as a vertical axis versus the current $i_{FF}$ flowing in the MR-fluid load generating unit 22 as a horizontal axis. As indicated by the line L3 in the graph of FIG. 3B, the load generated by the MR-fluid load generating unit 22 has the initial resistance value Ff when the value of the current is zero. Therefore, when the trainee M starts the training motion, the MR-fluid load generating unit 22 generates the load corresponding to the initial resistance value Ff, which can become a factor hampering smooth training. Consequently, it is necessary to cancel the load corresponding to the initial resistance value Ff by using the power-assisting motor 23.

In addition, actually, the magnitude of the load generated by the MR-fluid load generating unit 22 also depends on the velocity of the training motion. The dashed lines L4 and L5 respectively indicate the upper and lower limits of the relationship between the load Fr generated by the MR-fluid load generating unit 22 and the current $i_{FF}$ flowing in the MR-fluid load generating unit 22, where the upper and lower limits are determined in consideration of the velocity of the training motion.

5. Motor-Load Characteristic Information

Figure 3C:
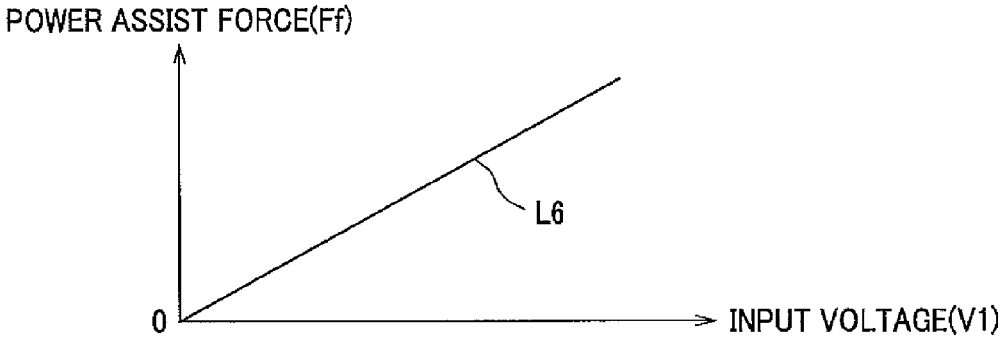
FIG. 3C is a graph indicating an example of motor-load characteristic information.

The motor-load characteristic information 323 is explained below with reference to FIG. 3C. As indicated in FIG. 3C, the motor-load characteristic information 323 can be represented by the line L6 in the graph of the power-assisting force Ff as a vertical axis versus the input voltage V1 of the power-assisting motor 23 as a horizontal axis. Since FIG. 3C does not indicate the relationship for the input voltage below zero, it is necessary to consider the direction of the power assistance when the power-assisting motor 23 is controlled (as explained in detail later).

6. Example of Game Screen

Figure 4:
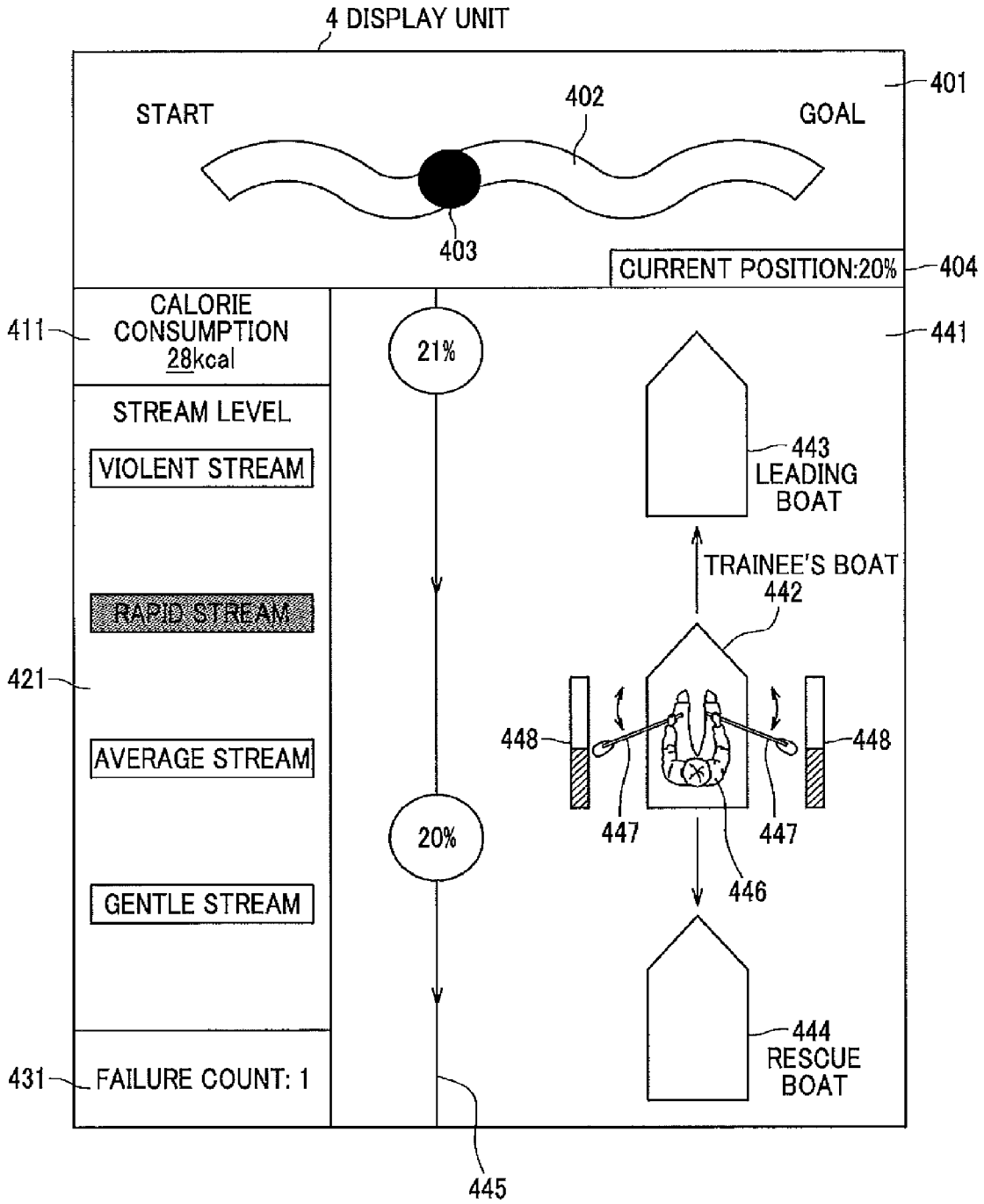
FIG. 4 indicates an example of a screen displayed by a display unit.

An example of the game screen displayed on the display unit 4 during the training is explained below. As illustrated in FIG. 4, the display unit 4 has display areas 401, 411, 421, 431, and 441. The information to be displayed on the respective display areas (display information) are stored as part of the game information 324 in the storage unit 32.

In the display area 401, a course indication 402, a progress icon 403, and a progress indication 404 in percentage are indicated. The course indication 402 schematically indicates the course of the training from the start to the goal by using a model of a river. The progress icon 403 indicates the progress of the training by the position on the indication of the river. The progress indication 404 indicates the progress in the training in percent.

In the display area 411, the consumption calorie at the moment is indicated.

In the display area 421, four stream levels "violent stream", "rapid stream", "standard stream", and "gentle stream" are indicated as options, and the "rapid stream" is selected in the example of FIG. 4. However, generally, the number of the stream levels may be any number equal to or greater than one. Alternatively, the game information 324 may be arranged to allow continuous setting of the stream level in the range from 0 to 100%.

In the display area 431, the number of failures in the operation (which is explained later) is indicated.

In the display area 441, a trainee's boat 442, a leading boat 443, a rescue boat 444, mileposts 445, a rower 446, oars 447 and a meter indication 448 are displayed. In the example of FIG. 4, the leading boat 443, the rescue boat 444, the mileposts 445, and the meter indication 448 are indicated in an arrangement corresponding to a reference motion at a reference speed. In the game screen of FIG. 4, it is assumed that the leading boat 443 and the rescue boat 444 are moving forward (upward in FIG. 4) at a constant speed, although the leading boat 443 and the rescue boat 444 are displayed at the fixed positions in the display area 441.

The trainee's boat 442 can move upward or downward in the display area 441 according to the speed determined to be achieved by the trainee's training motion. Specifically, the position of the trainee's boat 442 is not changed when the speed determined to be achieved by the trainee's training motion is equal to the reference speed. However, when the speed determined to be achieved by the trainee's training motion is faster than the reference speed, the position of the trainee's boat 442 in the display area 441 moves upward. On the other hand, when the speed determined to be achieved by the trainee's training motion is slower than the reference speed, the position of the trainee's boat 442 in the display area 441 moves downward. That is, the indication of the trainee's boat 442 is changed according to the difference of the speed determined to be achieved by the trainee's training motion from the reference speed. In addition, the oars 447 handled by the rower 446 in the display area 441 move together with the trainee's training motion (i.e., according to the detection signal from the displacement detection sensor 25). The meter indication 448 indicates the reference positions (motions) for the outer ends of the oars 447 assumed to realize the reference speed. Therefore, when the trainee's training motion coincides with the reference motion, the meter indication 448 and the outer ends of the oars 447 move in synchronization with each other. The mileposts 445 are markers being arranged along the river 402 and indicating the progress in the course of the training. The mileposts 445 move downward with time.

Figure 5:
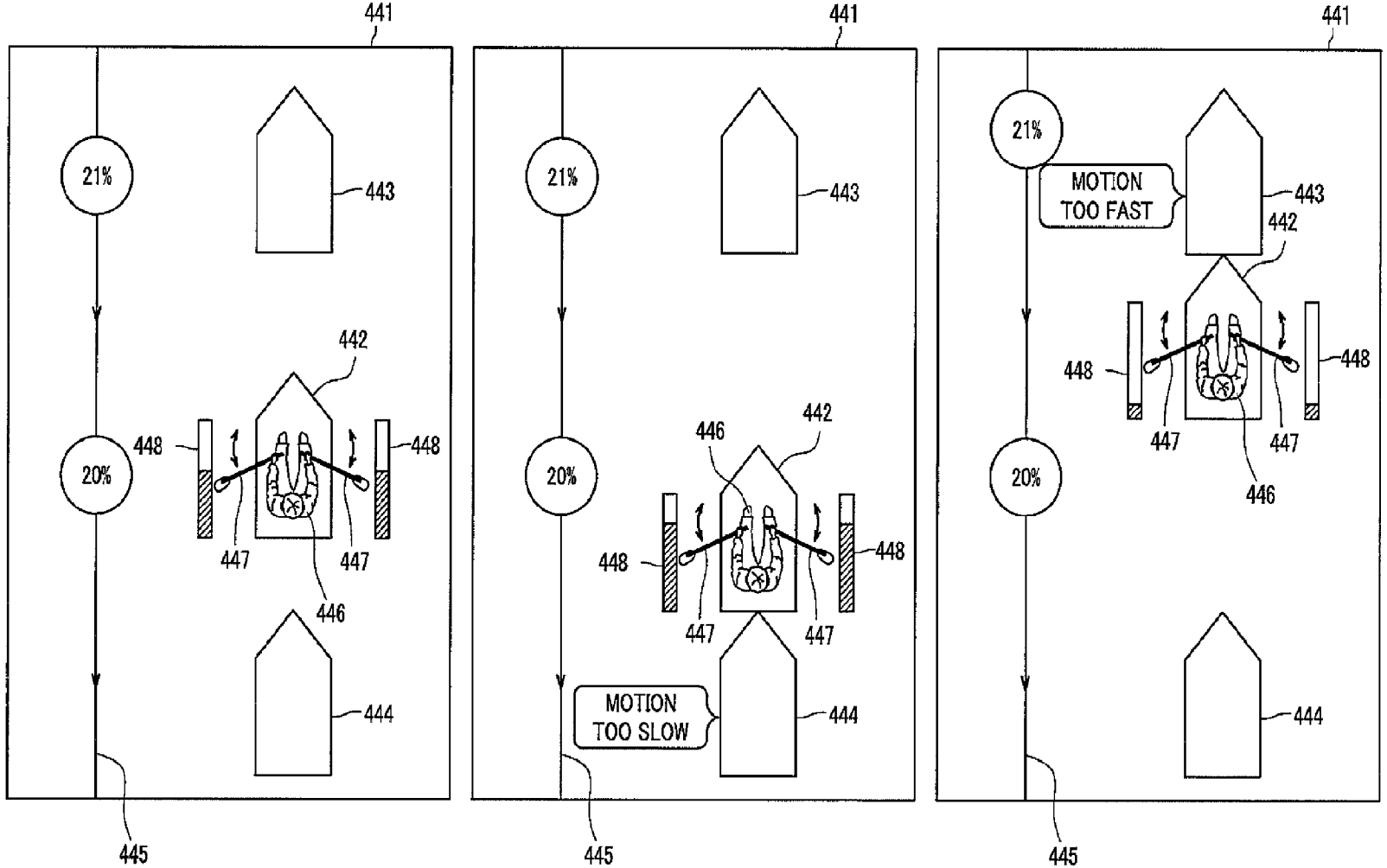
FIG. 5A indicates an example of a game screen displayed in a normal situation.
FIG. 5B indicates an example of a game screen displayed in a failed situation.
FIG. 5C indicates an example of a game screen displayed in a failed situation.

Next, an exemplary game screen displayed in a successful case in which a normal training motion is successfully made as illustrated in FIG. 5A and exemplary game screens displayed in failed cases 1 and 2 in which the training motion is failed as illustrated in FIGS. 5B and 5C are explained below.

In the example of FIG. 5A for the normal training motion, the trainee's boat 442 is not in contact with either of the leading boat 443 and the rescue boat 444. In the exemplary game screen in the failed case 1 illustrated in FIG. 5B, the trainee's training motion is considerably slower than the reference motion. In this case, it is preferable that the audio unit 5 output the sound message "Your motion is too slow." In the exemplary game screen in the failed case 2 illustrated in FIG. 5C, the trainee's training motion is considerably faster than the reference motion. In this case, it is preferable that the audio unit 5 output the sound message "Your motion is too fast."

7. Functions and Operations

Figure 6:
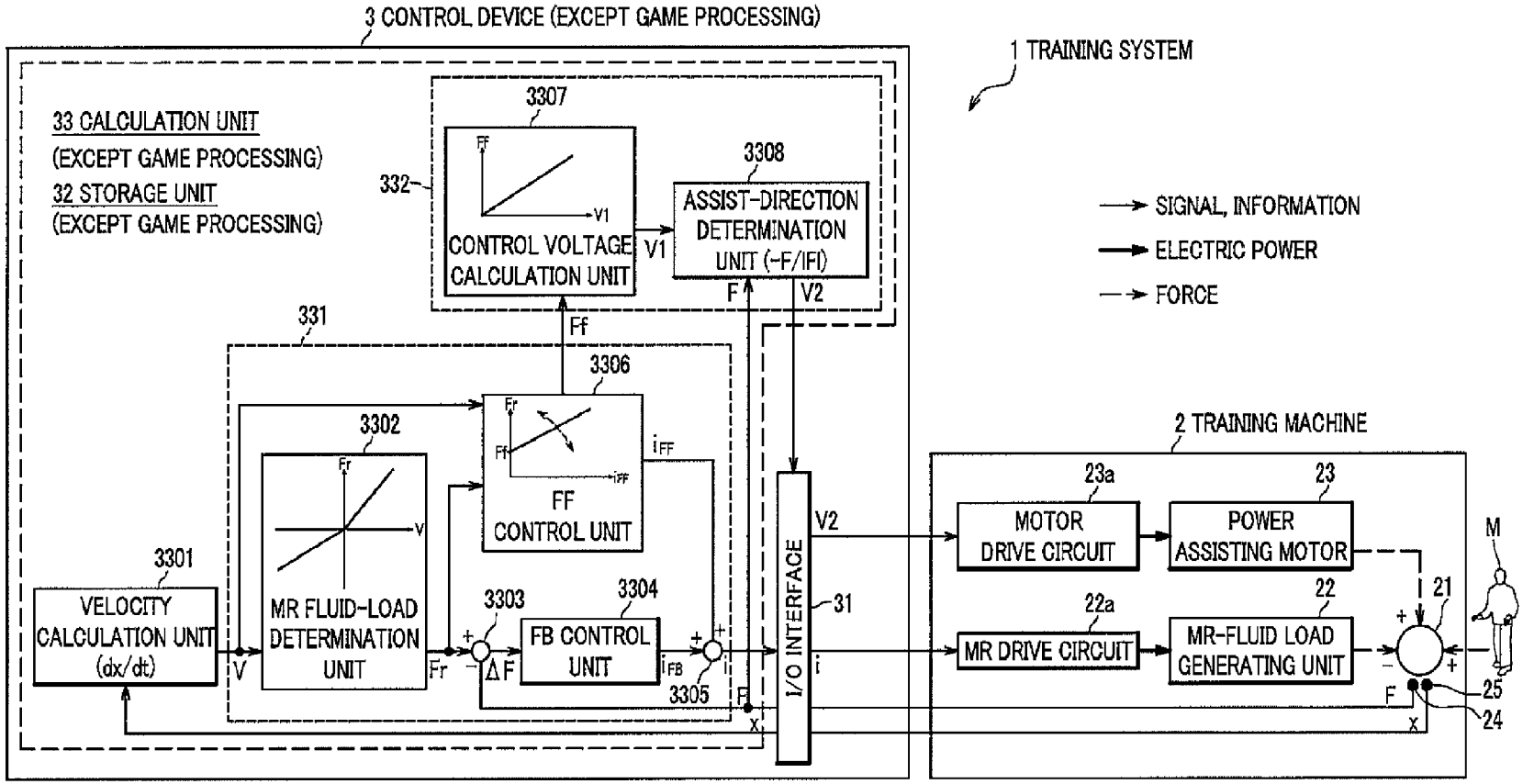
FIG. 6 is a block diagram indicating control blocks in a control device and the training machine.

Hereinbelow, the functions and operations of the training system 1 are explained with reference to FIGS. 6 and 7. As illustrated in FIG. 6, the MR-fluid load control unit 331 includes an MR-fluid load determination unit 3302, an FB (feedback) control unit 3304, and an FF (feed forward) control unit 3306. In addition, the motor control unit 332 includes a control-voltage calculation unit 3307 and an assist-direction determination unit 3308. Further, the calculation unit 33 includes a velocity calculation unit 3301. FIG. 7 indicates a flow of processing in the training system 1. The operations of the training system 1 are explained below step by step.

Figure 7:
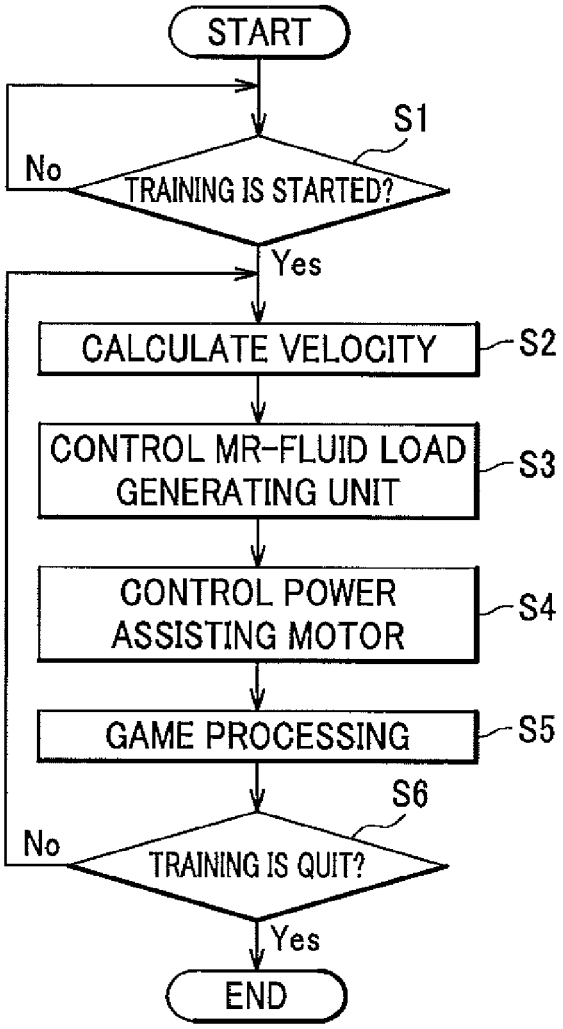
FIG. 7 is a flow diagram indicating a flow of processing in the training system.

In step S1 in FIG. 7, the calculation unit 33 in the control device 3 determines whether or not the trainee starts exercise (in step S1 in FIG. 7). When "No" is determined in step S1, the operation in step 1 is repeated. When "Yes" is determined in step S1, the operation goes to step S2. The determination in step S1 may be made on the basis of, for example, whether or not an instruction from the input unit 6 to start the training exists or whether or not adding force to the training machine 2 by the trainee M is detected by the load detection sensor 24.

In step S2, the velocity calculation unit 3301 calculates the velocity V of training motion on the basis of displacement information x obtained from the displacement detection sensor 25.

In step S3, the MR-fluid load control unit 331 controls the MR-fluid load generating unit 22 as follows.

First, the MR-fluid load decision unit 3302 determines the MR-fluid load (target load) Fr on the basis of the velocity V of the training motion and the velocity-load relationship information 321 (as indicated in FIG. 3A).

Thereafter, the FF control unit 3306 calculates the value of first control current $i_{FF}$ of the MR-fluid load generating unit 22 on the basis of the target load Fr and the MR-fluid load characteristic information 322 (as indicated in FIG. 3B). Subsequently, the MR-fluid load control unit 331 calculates as a load deviation ΔF the difference between the target load Fr and the actual load (the actually occurring load) detected by the load detection sensor 24 (by the symbol 3303 in FIG. 6).

In addition, the FB control unit 3304 calculates the value of second control current $i_{FB}$ by PID (Proportional Integral Derivative) control on the basis of the load deviation ΔF. Then, the MR-fluid load control unit 331 calculates as third control current i the sum of the value of the first control current $i_{FF}$ and the value of the second control current $i_{FB}$ (by the symbol 3305 in FIG. 6), and controls the MR-fluid load generating unit 22 with the third control current i.

In step S4, the motor control unit 332 controls the power-assisting motor 23. Specifically, the control-voltage calculation unit 3307 calculates the absolute value V1 of the control voltage of the power-assisting motor 23 on the basis of the power-assisting force (the initial resistance value Ff) and the motor-load characteristic information 323 (as indicated in FIG. 3C). The power-assisting force (the initial resistance value Ff is obtained from the FF control unit 3306, and may be a value corrected according to the velocity of the training motion.

Subsequently, the assist-direction determination unit 3308 determines the direction in which the power is to be assisted by the power-assisting motor 23, by calculating the inverse −F/|F| of the polarity F/|F| of the actual load F obtained from the load detection sensor 24, and controls the power-assisting motor 23 with a control voltage V2, which is obtained by multiplying the absolute value V1 of the control voltage by the inverse −F/|F| of the polarity.

In step S5, the game processing unit 333 performs game processing. Specifically, the game processing unit 333 performs processing for realizing details of the game on the basis of the game information 324 and the displacement information from the displacement detection sensor 25, makes the display unit 4 display the game screen (as illustrated in FIG. 4), and makes the audio unit 5 output the sound.

In step S6, the calculation unit 33 determines whether or not the trainee M quits the training. When "No" is determined in step S6, the operation goes back to step S2. When "Yes" is determined in step S6, the processing of FIG. 7 is completed. The determination in step 6 may be made on the basis of, for example, whether or not an instruction from the input unit 6 to terminate the training exists or whether or not adding force to the training machine 2 by the trainee M is still detected by the load detection sensor 24.

8. Advantages

The training system 1 according to the present embodiment explained above has the following advantages.

(1) Since the training system 1 operates as above, the trainee M can perform, in addition to the simple training for the muscular strength and the muscular endurance, training like a game play in such a manner that the game proceeds in response to the training motion, by watching the game screen on the display unit 4 and/or listening to the sound from the audio unit 5. Therefore, the trainee M uses the brain and the nervous system concurrently with the muscles, so that the neuromuscular coordination can be improved.

(2) Since the MR fluid is used for generation of the load, the training system 1 can achieve high-speed response, high load, low cost, and low power consumption.

(3) In the case where the magnitude of the load and the reference motion are preset in consideration of safety and effect, the trainee M can perform training like a game play by making safe and effective motions with enjoyment and high motivation. In addition, since the training system 1 enables training with appropriate loads, for example, the training system 1 can contribute to prevention of functional decline and lifestyle-related diseases (including metabolic syndromes), and enables the trainee to perform aerobic exercise.

(4) Since the power-assisting motor 23 assists the trainee's training motion, the trainee M can smoothly perform exercise.

(5) By determining the magnitude of the target load according to the velocity of the trainee's training motion, the trainee M can perform training with appropriate loads.

(6) By performing the PID control, the difference between the target load and the actual load can be reduced.

(7) Since the position adjustment unit 207 provided for fixing the upper-extremity operation unit 208 with the pin 209 has a plurality of holes, the position of the upper-extremity operation unit 208 can be adjusted according to the body size and preference of the trainee M.

(8) Since the position adjustment unit 217 provided for fixing the lower-extremity operation unit 218 with the pin 219 has a plurality of holes, the position of the lower-extremity operation unit 218 can be adjusted according to the body size and preference of the trainee M.

9. Another Example of Game Screen

Figure 8:
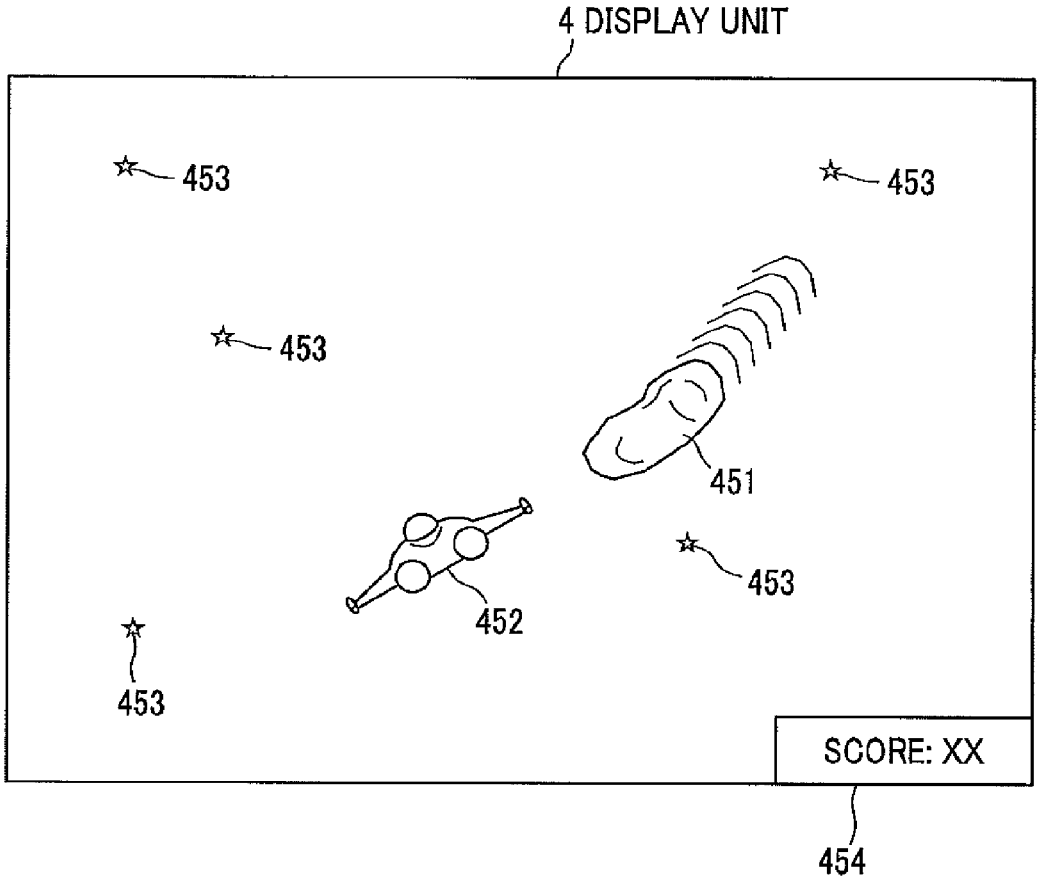
FIG. 8 indicates another example of a game screen displayed in a normal situation.

Next, another example of a game screen which is displayed on the display unit 4 during the training is explained below with reference to FIG. 8. The game screen of FIG. 8 is presented for a game in which a rocket in outer space is operated so as not be hit by space debris and the like. In the case where the above game is implemented, the MR-fluid load generating unit 22 is provided for each of the left and right arms and left and right legs of the trainee M (i.e., four MR-fluid load generating units are provided) so that a load is independently imposed on each of the left and right arms and left and right legs.

In the game screen of FIG. 8, a plurality of stars 453 are illustrated in the background, and the rocket 452 is indicated near the center of the game screen. The trainee M can operate the position of the rocket 452 by the trainee's training motion so that the rocket 452 is not hit by a piece of space debris 451. For example, the training system 1 may be configured in such a manner that the rocket 452 moves in the forward right direction when the trainee M pushes the lower-extremity operation unit 218 with the right leg, in the forward left direction when the trainee M pushes the lower-extremity operation unit 218 with the left leg, in the backward right direction when the trainee M pulls the upper-extremity operation unit 208 with the right arm, and in the backward left direction when the trainee M pulls the upper-extremity operation unit 208 with the left arm. Alternatively, the training system 1 may be configured in such a manner that the trainee M can make the rocket 452 turn left and right by moving the left and right arms, and make the rocket 452 move up and down by moving the left and right legs. In the above cases, the game may be designed to determine the score 454 on the basis of, for example, the movement of the rocket 452 and the number of pieces of space debris the collision with which has been successfully avoided.

The above game configuration realizes improvement of neuromuscular coordination as well as the muscular strength and the muscular endurance. In addition, the trainee M can perform training like a game play by making safe and effective motions with enjoyment and high motivation.

10. Variations

The present invention is not limited to the embodiment and examples which are explained above, and any part of the constructions and the operations of the explained embodiment and examples can be modified or changed as needed within the scope of the present invention. For example, the following variations are included in the scope of the present invention.

(1) The present invention can be applied to any other composite or simple training machines (e.g., arm curl machines and chest press machines) as well as the composite machine of the leg press machine and the rowing machine.

(2) The relationship between the velocity of the training motion and the target load included in the velocity-load relationship information 321 (as indicated in FIG. 3A) may be changed. For example, when at least one of the velocity of the trainee's training motion and the load generated by the training motion is out of a predetermined reference range, the relationship between the velocity and the target load in the velocity-load relationship information may be changed so that the at least one of the velocity and the load generated by the training motion falls within the predetermined reference range.

(3) The fluid characteristics of the MR fluid vary (deteriorate) when the temperature becomes equal to or higher than 150° C. Therefore, it is preferable, but not necessary, to arrange in the vicinity of the MR-fluid load generating unit 22 a temperature detection means for detecting the internal temperature of the MR-fluid load generating unit 22, and configure the training system 1 to stop the control of the training machine 2 when the internal temperature of the MR-fluid load generating unit 22 becomes equal to or higher than 150° C.

(4) It is preferable, but not necessary, to arrange a first solenoid for moving the pin 209, and adjust the position of the upper-extremity operation unit 208 by controlling the power-assisting motor 23 and the first solenoid so as to insert the pin 209 through one of the holes in the position adjustment unit 207 and the hole in the upper-extremity operation unit 208.

(5) It is preferable, but not necessary, to arrange a second solenoid for moving the pin 219, and adjust the position of the lower-extremity operation unit 218 by controlling the power-assisting motor 23 and the second solenoid so as to insert the pin 219 through one of the holes in the position adjustment unit 217 and the hole in the lower-extremity operation unit 218.

(6) It is preferable, but not necessary, to make an adjustment of the excursions in the upper-extremity operation unit 208 and the lower-extremity operation unit 218 in correspondence with the difference in the movable range between the upper extremities and the lower extremities or an adjustment of the magnitudes of the loads imposed on the upper extremities and the lower extremities by changing the gear ratio of the two sprockets with which each of the chains 232 and 233 is engaged. Generally, the movable range of the lower extremities is smaller than the movable range of the upper extremities.

(7) The conventional game controllers can be used in the training systems according to the present invention. In such cases, it is possible to increase the variety of games. Any games can be used in the training systems according to the present invention as well as the aforementioned games of the boat and the rocket. For example, car racing games, shooting games, dancing games, games of playing music instruments (e.g., drums), fighting games, sports games, quiz games (e.g., games of multiple choice quizzes), and the like can be used.

What is claimed is:

1. A training system configured to train a predetermined part of a body of a trainee, comprising:

a training machine;

a control device configured to control the training machine; and a display unit configured to display a game screen during training of a trainee;

wherein the training machine includes:

a Magnet Rheological fluid (MR-fluid) load generating unit configured to generate a load to be exerted on the trainee, by using an MR-fluid having a variable viscosity depending on a magnetic field strength, a mechanical unit configured to transmit to the trainee, the load generated by the MR-fluid load generating unit;

a displacement detection sensor configured to detect a training motion of the trainee;

a power-assisting motor configured to assist the training motion of the trainee, and the control device includes:

a storage unit configured to store MR-fluid load characteristic information on a relationship between a current through the MR-fluid load generating unit and the load generated by the MR-fluid load generating unit, a target load during training of the trainee, and game information on details of a game related to the training, and a calculation unit configured to control the MR-fluid load generating unit by using the MR-fluid load characteristic information and the target load, to generate an image corresponding to the training motion on the basis of the game information and the training motion for the display unit to display the image, and to determine a power-assisting force by use of the MR-fluid load characteristic information to further control the power-assisting motor on the basis of the power assisting force, wherein the predetermined part of the body includes an upper body and a lower body of the trainee, and wherein the mechanical unit of the training machine includes:

an upper-body operation unit configured to be operated by the upper body of the trainee by applying a force to the upper-body operation with the upper body, a lower-body operation unit configured to be operated by the lower body of the trainee by applying a force to the lower-body operation unit with the lower body, a first chain linked with the upper-body operation unit and a pair of first sprockets movably supporting the first chain, a second chain linked with the lower-body operation unit and a pair of second sprockets movably supporting the second chain, a third chain configured to transmit the load generated by the MR-fluid load generating unit and a pair of third sprockets movably supporting the third chain, a mechanism configured to transmit a driving force generated by the power-assisting motor to the third chain, and a fourth chain and a fifth chain cooperated to link the first chain, the second chain and the third chain together, wherein the fourth chain engages a first pair of different sprockets selected from the first sprockets, the second sprockets, and the third sprockets, wherein the fifth chain engages a second pair of different sprockets selected from the first sprockets, the second sprockets, and the third sprockets, and wherein the first pair of different sprockets differs from the second pair of different sprocket;

wherein the mechanical unit includes a first position adjustment unit fixed to the first chain and second position adjustment unit fixed to the second chain, each of the upper-body operation unit and the lower-body operation unit has a hole, each of the first position adjustment unit and the second position adjustment unit has holes, wherein inserting a first pin through one of the holes of the first position adjustment unit and through the hole of the upper-body operation unit, fixes the first position adjustment unit to the upper-body operation unit, and wherein inserting a second pin through one of the holes of the second position adjustment unit and through the hole of the lower-body operation unit, fixes the second position adjustment unit to the lower-body operation unit.

2. The training system according to claim 1, wherein the storage unit further stores velocity-load relationship information, which indicates a relationship between a velocity of the training motion of the trainee and the target load corresponding to the velocity, and wherein the calculation unit of the control device is configured to calculate the velocity of the training motion of the trainee on the basis of a detection signal outputted from the displacement detection sensor, and to control the MR-fluid load generating unit and the power-assisting motor by use of the velocity-load relationship information and the velocity calculated by the calculation unit.

3. The training system according to claim 2, wherein the training machine further includes a load detection sensor which detects a load generated by the training motion of the trainee, and wherein the calculation unit of the control device is configured to calculate a difference between the target load and the load detected by the load detection sensor, and to control the MR-fluid load generating unit so as to decrease the difference.

4. The training system according to claim 2, wherein the training machine further includes a load detection sensor which detects a load generated by the training motion of the trainee, and wherein in a case where at least one of the velocity of the training motion of the trainee and the load generated by the training motion of the trainee falls outside a predetermined reference range, the calculation unit of the control device is configured to change the relationship between the velocity and the target load in the velocity-load relationship information so that at least one of the velocity and the load generated by the training motion of the trainee falls within the predetermined reference range.

5. The training system according to claim 1, wherein the mechanical unit further includes a first solenoid configured to move the first pin and a second solenoid configured to move the second pin, wherein the calculation unit of the control device is configured to control the power-assisting motor and the first solenoid to have the first pin inserted through one of the holes of the first position adjustment unit and through the hole of the upper-body operation unit, and wherein the calculation unit controls the power-assisting motor and the second solenoid to have the second pin inserted through one of the holes of the second position adjustment unit and through the ole of the lower-body operation unit.

* * * * *